US011203792B2

(12) United States Patent
Yan et al.

(10) Patent No.: US 11,203,792 B2
(45) Date of Patent: Dec. 21, 2021

(54) METHOD FOR PREPARING OXIDE DISPERSION STRENGTHENING F/M STEEL USING SMELTING AND CASTING PROCESS

(71) Applicant: University of Science and Technology Beijing, Beijing (CN)

(72) Inventors: Qingzhi Yan, Beijing (CN); Zhiyuan Hong, Beijing (CN)

(73) Assignee: University of Science and Technology Beijing, Beijing (CN)

( * ) Notice: Subject to any disclaimer, the term of this patent is extended or adjusted under 35 U.S.C. 154(b) by 274 days.

(21) Appl. No.: 16/052,640

(22) Filed: Aug. 2, 2018

(65) Prior Publication Data

US 2019/0144962 A1 May 16, 2019

(30) Foreign Application Priority Data

Nov. 13, 2017 (CN) ..... 201711113150.3

(51) Int. Cl.

| | |
|---|---|
| ***C21D 8/00*** | (2006.01) |
| ***C21D 6/00*** | (2006.01) |
| ***C22C 38/32*** | (2006.01) |
| ***C22C 38/28*** | (2006.01) |
| ***C22C 38/24*** | (2006.01) |
| ***C22C 38/22*** | (2006.01) |

(Continued)

(52) U.S. Cl.

CPC ..... *C21D 8/005* (2013.01); *C21D 6/002* (2013.01); *C21D 6/005* (2013.01); *C21D 6/008* (2013.01); *C22C 38/001* (2013.01); *C22C 38/002* (2013.01); *C22C 38/02* (2013.01); *C22C 38/04* (2013.01); *C22C 38/22* (2013.01); *C22C 38/24* (2013.01); *C22C 38/26* (2013.01); *C22C 38/28* (2013.01); *C22C 38/32* (2013.01); *C21D 2211/005* (2013.01); *C21D 2211/008* (2013.01)

(58) Field of Classification Search

None

See application file for complete search history.

(56) References Cited

U.S. PATENT DOCUMENTS

| | | | |
|---|---|---|---|
| 2003/0116239 | A1 | 6/2003 | Lambard et al. |
| 2015/0252458 | A1 | 9/2015 | Kim et al. |

FOREIGN PATENT DOCUMENTS

| | | | |
|---|---|---|---|
| CN | 101774012 | A | 7/2010 |
| CN | 102230096 | A | 11/2011 |

(Continued)

OTHER PUBLICATIONS

Espacenet translation of CN106756434 (Year: 2020).*
Espacenet translation of CN105274440 (Year: 2020).*

*Primary Examiner* — Patricia L. Hailey
*Assistant Examiner* — Christopher D. Moody

(57) ABSTRACT

A method for preparing oxide dispersion strengthening F/M steel using smelting and casting process, which belongs to the field of metal materials. The composition of the steel comprises: C: 0.08-0.15%, Cr: 8.0-14%, Mn: 0.45-0.6%, W: 1.0-2.5%, N: 0.05-0.07%, Ta: 0.010-0.20%, Ti: 0.02-0.55%, Si: 0.10-0.15%, V: 0.04-0.5%, O: 30-200 ppm, B<0.001%, S<0.003%, P<0.005%, Y powder in the casting mould is 0.01-1%, the rest is Fe. The rolling temperature of the steel is 1100° C.-800° C.; heat treatment after rolling comprises: quenching at 850-1100° C./15-120 min; tempering at 710-800° C./90-120 min. The material has high strength under high temperature and low ductile-brittle transition.

9 Claims, 7 Drawing Sheets

(51) Int. Cl.

| | |
|---|---|
| ***C22C 38/04*** | (2006.01) |
| ***C22C 38/02*** | (2006.01) |
| ***C22C 38/00*** | (2006.01) |
| ***C22C 38/26*** | (2006.01) |

(56) References Cited

FOREIGN PATENT DOCUMENTS

| | | | | |
|---|---|---|---|---|
| CN | 102268564 | A | | 12/2011 |
| CN | 102277525 | A | | 12/2011 |
| CN | 102560163 | A | | 7/2012 |
| CN | 105274440 | A | | 1/2016 |
| CN | 106756434 | A | * | 5/2017 |

* cited by examiner

METHOD FOR PREPARING OXIDE DISPERSION STRENGTHENING F/M STEEL USING SMELTING AND CASTING PROCESS

TECHNICAL FIELD

The disclosure belongs to the field of metal materials, and relates to a new process for preparing oxide dispersion strengthening (ODS) ferritic/martensitic (F/M) steel. The ODS steel produced by this process shows outstanding high temperature strength and high temperature creep resistance, and has such characteristics as good plasticity and high impact toughness.

BACKGROUND

The increasing demand for global energy and the continuous improvement of environmental awareness have promoted the development and utilization of clean energy such as nuclear energy. The nuclear reactor is exposed to the harsh environment of high temperature, high pressure and strong irradiation for a long time, so it is required that the structural materials have good high temperature stability, high irradiation swelling resistance and excellent plastic processing property at the same time. Ferritic/martensitic steel is the main candidate structural material for nuclear reactor because of its excellent property of irradiation swelling resistance, high thermal conductivity, low thermal expansion coefficient, mature preparation process and more perfect performance database. However, the main problem of ferritic/martensitic steel is low strength at high temperature. When temperature is higher than 600° C., the tensile strength decreases nearly 50%. At the same time, under the action of high temperature and high stress creep, the deformation of the material is serious and the fracture strength decreases. The decline of these high temperature performance seriously restricts the upper limit of its usage temperature. How to improve hot strength and high temperature creep resistance of ferritic/martensitic steel for nuclear reactor has been the research direction of scholars all over the world. Compared with the traditional ferritic/martensitic steel with the same composition, oxide dispersion strengthening (ODS) steel has excellent high temperature strength and creep resistance, because of the rare earth oxide nanoparticles are not easy to gather and grow and dissolve at high temperature, which can dispersively strengthen matrix and pin dislocation. At present, ODS steel is prepared mostly by mechanical alloying technology at home and abroad, that is, the rare earth oxide ceramic particles are mixed with steel powder in high energy ball mill, then the oxide ceramic particles and the steel powder are mixed, refined and alloyed through high rolling of ball mill and mechanical milling of grinding ball; the mixed powder is densified by hot isostatic pressing sintering to obtain steel ingot; and the microstructure and mechanical properties of the steel ingot are improved by extrusion or forging-rolling. The ODS steel prepared by mechanical alloying shows high tensile strength, creep strength and unusual ability of anti-irradiation damage, which can increase usage temperature to 650° C. or even higher. Studies show that the stable particle size of $Y_2O_3$ particles at the nanometer scale is the main reason for the excellent high temperature mechanical properties, creep properties and antiradiation properties of ODS steel. The patent (publication number CN 102277525 A) provides a method for obtaining sintered body of ODS steel by mechanical alloying of iron chromium pre-alloyed powder and nanometer oxide achieved by high energy ball milling, and by hot pressing and hot isostatic pressing treatment. In the patent of invention, mother alloy is refined in a vacuum induction smelting furnace used by the inventor and argon gas atomization is used to get Fe—Cr—W—Si—Zr—Ti—Y pre-alloyed powder; and appropriate amount of Si, Zr, Ti and Y is added to the pre-alloyed powder to ensure the precipitation of ultrafine complex oxide nanoparticles in the ODS steel; the pre-alloyed powder and yttrium oxide ceramic powder are dispersively mixed by long time ball milling, and are densified by hot isostatic pressing sintering to obtain ODS steel.

Although preparing ODS steel through mechanical alloying is widely used, the problems in this process are generally acknowledged: first, due to limitation of mechanical alloying process, single batch production is small and batch stability is poor; second, process is long, and manufacturing cost is high; third, plasticity of the material is low and processing performance is poor.

Considering the requirements of preparation of mass production, stabilization and low cost of steel, researchers in various countries have been exploring how to obtain fine and evenly distributed oxide dispersion strengthening steel through a mature and simple smelting process, but there are few reports and little effect. After a long period of exploration, the applicant of the disclosure developed an advanced smelting process: rare earth elements were dissolved into molten steel and iron oxide powder-containing oxygen carriers was placed previously into ingot mould; the iron oxide dissolved and melted, then entered into the molten steel during the casting process, and oxygen combined with the rare earth elements in the molten steel to form dispersively distributed oxide. The technology was applied for patent (No. 201510808687.6). However, in transmission electron microscope observation and analysis of the materials prepared by this technology, it is found that although the above technology can obtain ODS steel of dispersively distributed oxide, the oxide particles are larger, and the particles having a size larger than 100 nanometers account for 60%; the oxide particles gather and grown at high temperature, which has not significant improvement for high temperature strength. To this end, the inventor continues to improve the process, completely changing the way of addition of rare earth and the control of oxygen source; finally the oxide particles obtained are below 5 nm, most of which are around 1 nm, not binary but ternary rare earth oxides, that are $YTiO_3$ particles; the oxide of this composition is stable at high temperature, and the ability of dislocation pinning is strong, which greatly improves the high temperature strength and creep resistance of steel.

SUMMARY

This disclosure provides a new method for smelting and preparing ODS steel, overcoming many problems brought by current generally adopted mechanical alloying process for preparing ODS steel, such as complex process, long flowsheet, poor single batch production and poor batch stability, by thorough improvement of traditional smelting process and creative labor. The basic principle of the disclosure is based on the strong binding energy between the rare earth element RE and O, which is very easy to form stable rare earth oxides, and controls particle size of the rare earth oxides by controlling the concentration and addition manner of oxygen and the rare earth elements. Oxygen has a high saturation concentration (0.23%) in molten steel, so a large amount of oxygen can be dissolved in the molten steel, and the concentration of oxygen can be adjusted by controlling the purities of the raw materials and the vacuum degree in the smelting furnace. This application uses rare earth element yttrium, and the melting point of yttrium is 1522° C., lower than the temperature of molten steel which is 1600° C., so yttrium element can be dissolved and melted rapidly in the molten steel. Based on the above principle, the contents of our disclosure are:

a method for preparing oxide dispersion strengthening (ODS) F/M steel using smelting and casting process, which is characterized by using vacuum induction and magnetic stirring process for steelmaking, with a smelting temperature above melting point of iron by 100-200° C.; a molten steel with an oxygen activity of 30-200 ppm is cast into a casting mould of pre-addition of a rare earth element Y that matches [O] in the molten steel, and ODS steel of dispersively distributed rare earth oxide is obtained by the combination of the rare earth element Y and [O] in the molten steel; the steps are as follows:

1. a rare earth Y powder that matches the amount of $Y_2O_3$ needed to get is added into the casting mould (0.01-1 wt %);

2. ingot iron are added to a crucible, power is supplied when it is pumped to a vacuum value of 5-40 Pa, to start refining, and the smelting temperature is above the melting point of iron by 100-200° C.;

3. a deoxidation depth is controlled by burning loss of deoxidation element Al in the smelting process, and alloying element is added to conduct alloying when oxygen concentration[O] reaches 30 ppm-200 ppm;

4. after microalloying process is finished, the molten steel is cast into the casting mould, and a casting temperature depends on a fluidity of the molten steel; a temperature of the molten steel is reduced as far as possible while the fluidity is ensured;

5. hot forging and hot rolling are performed for casting ingot;

6. heat treatment is performed for a heat-processed slab, to obtain oxide dispersion strengthening (ODS) ferritic/martensitic (F/M) steel.

Further, the raw materials used are pure iron block (wire), pure chromium powder (coarse particle), pure tungsten powder (coarse particle), pure tantalum powder (coarse particle), pure titanium powder (coarse particle), pure Mn powder (coarse particle), pure silicon block, pure vanadium powder (fine particle) and pure yttrium powder (fine particle); the purity of each of the raw materials is above 99.9%; the coarse particle refers to the particle with a size of greater than or equal to 297 μm (50 mesh), and the fine grain refers to the particle with a size of smaller than or equal to 15 μm (900 mesh).

Further, the percentages for various components in the total mass are as follows: C: 0.08-0.15%, Cr: 8.0-14%, Mn: 0.45-0.6%, W: 1.0-2.5%, N: 0.05-0.07%, Ta: 0.010-0.20%, Ti: 0.02-0.55%, Si: 0.10-0.15%, V: 0.04-0.5%, O: 30-200 ppm, B<0.001%, S<0.003%, P<0.005%, Y powder in the casting mould: 0.01-1%, the rest is Fe.

The method for preparing oxide dispersion strengthening (ODS) F/M steel using smelting and casting process described above, wherein, the steps of hot forging and hot rolling are as follows:

(5) a first thermal deformation is performed by forging or rolling for steel ingots or continuously casting steel bars, to obtain semi-finished product;

(6) the semi-finished product is heated to a range of 1150° C.-1200° C., and a deformation is performed again by using a controlled rolling and cooling process through hot rolling until a production with required shape and size is obtained;

(7) the production cooled to a room temperature is heated to a temperature range of 850-1100° C. for 15-120 min, to perform austenitizing heat treatment;

(8) the production after austenitizing heat treatment is cooled to a temperature of below 50° C., and then the production is heated to a temperature range of 710-800° C. for 90-150 min, to perform tempering heat treatment to obtain martensitic production.

Further, a temperature range of forging or rolling in step (1) is 800° C.-1100° C.

Further, a cooling operation after the thermal deformation in step (2) is first performed in water to cool to 600° C., and then performed in air to cool to room temperature.

Further, for the controlled rolling and cooling process in step (2), an onset rolling temperature is controlled at 1050-1150° C., a final rolling temperature is controlled at 800-950° C., and online spray cooling is used after rolling.

Further, the austenitizing heat treatment system in step (3) is: quenching at 850-1100° C./15-120 min, tempering at 710-800° C./90-120 min; and a cooling operation after austenitizing heat treatment is performed in oil.

Further, a cooling operation after tempering heat treatment in step (4) is performed in air.

Compared with the generally adopted mechanical alloying process for preparing ODS steel, the disclosure has obvious advantages such as simple process and simple flow. The steel prepared according to the above composition and heat treatment process is ferritic/martensitic steel (FIG. 1 is TEM photograph of the organization in embodiment 1). It can be seen from the diagram that the matrix of the ODS steel prepared by the process of the application is martensite and the width of the lath is 0.2 μm. In order to better illustrate the feasibility of ODS steel prepared by the process, the inventor made a deeper analysis of the precipitated phase. Transmission electron microscopy (TEM) technology uses parallel high-energy electron beam to irradiate a thin film sample that can pass through electron. Due to the scattering effect of the sample to electron, the scattering wave will produce two kinds of information behind the objective lens. Electron diffraction patterns containing information of crystallography or crystal structure are formed on rear focal plane of the objective lens; and a high magnification topography image or a high resolution image reflecting the internal structure of the sample are formed on image plane of the objective lens. Scanning electron microscopy (SEM) technology uses focused low-energy electron beam to scan the surface of bulk sample, using secondary electron imaging and back reflection electron imaging produced by the interaction of electron and sample, to obtain information such as surface morphology, chemical composition and crystal orientation. Scanning transmission electron microscopy (STEM) technology is an ingenious combination of TEM and SEM, which uses a focused high-energy (usually 100-400 keV) electron beam (the diameter of incident electron beam is up to 0.126 nm) to scan a thin film sample that can pass through electron, using elastic scattering electron and inelastic scattering electron generated by the interaction of electron and sample, to perform imaging, electron diffraction or microscopic analysis. FIG. 2 and FIG. 3 are low magnification STEM photograph of spherical aberration corrected transmission electron microscope of the sample in specific embodiment 1. FIG. 2 (*a*) and FIG. 2 (*b*) correspond to high-angle annular dark field (HAADF) image and bright field image in the same region, respectively, and the zone axis of martensite matrix is [001]m. White dots in FIG. 2(*a*) are regions of atomic numbers higher than those of matrix Fe. The regions corresponding to these white dots are black dots in FIG. 2 (*b*). Thus, it can be determined by HAADF images of FIG. 2 (*a*) and FIG. 2 (*b*) that a large number of precipitated phases below 5 nm are evenly dispersed in the ODS steel prepared by the application process of the disclosure. By further magnifying HAADF images in FIG. 3 (*a*) and FIG. 3 (*b*), it indicates that these precipitated phases are completely coherent with the matrix. By calculating the distance and included angle of the spot and plane, the inventor deduced that the second phase is $YTiO_3$ or $Ti_2Y_2O_7$.

In order to further determine the composition and number density of rare earth oxides, three dimensional atomic probe tomography (3DAPT) was used to further analyze the sample. Under the conditions of ultra high vacuum and liquid nitrogen cooling, sufficient positive pressure was exerted on tip sample, and surface atoms of the sample begin to form ions and leave the tip surface. The evaporated ions are received by the detector and the position signals of two dimensional atoms are output. At the same time, the flight time of ions is measured by time-of-flight mass spectrometer to identify the chemical composition of single atom. Finally, the three dimensional atomic distribution information of the material is restored by software reconstruction. FIG. 4 and FIG. 5 are three dimensional scattergrams of O, Ti, Y and $YTiO_3$ obtained from the equal concentration surface method of samples in embodiment 2 of the disclosure. It can be seen from the scattergrams that spatial distribution positions for O, Ti and Y are highly consistent and as the same as the spatial position for the three of $YTiO_3$ coming together, and the number density of the precipitated phase of $YTiO_3$ is $6*10^{24}/m^3$. To sum up, through the analysis of 3D APT, the inventor further proved that oxide dispersion strengthening steel with dispersion phase of $YTiO_3$ and the particle size of 5 nm can be prepared in accordance with the process applied by the inventor.

The ODS low activation ferritic/martensitic steel has a room-temperature mechanical property similar to those of non-ODS steel, but has an excellent high temperature mechanical properties: the tensile strength is more than 115 MPa at 800° C., and the elongation percentage is about 46.8%; while the tensile strength of non-ODS steel is 68 MPa at 800° C., and the elongation percentage is 52.7%. It can be seen that the high temperature strength of the ODS steel prepared by the disclosure is nearly twice that of non-ODS steel.

The ODS steel prepared by the new process has high hardenability and low retained austenite content, and full martensitic structure can be obtained. W, V and Ta are strong carbide forming elements, which have significant strengthening effect. The dispersively distributed $YTiO_3$ does not occur to dissolve and, gather and grow at high temperature. It can significantly improve the high temperature creep resistance of the material. FIG. 6 and FIG. 7 give a comparison of the results of high temperature creep at 650° C. and 120 MPa for the ODS steel obtained by the specific embodiments 1 and 2 of the present disclosure and the conventional F/M steel (non-ODS steel). It can be seen from the diagram that under the same temperature and stress, the ODS steel prepared in accordance with the invention application of the disclosure has entered the rapid creep stage after 3200 h and 3400 h, respectively; and the traditional F/M steel which is not prepared in accordance with the process has entered the rapid creep stage after 1000 h and 800 h, respectively. At the same time, when the same creep is reached, under the condition of 2%, the time required for the preparation of ODS steel in accordance with the application of the disclosure is 3250 h and 4250 h, respectively; while the time required for the traditional F/M steel which is not prepared by the process is 1700 h and 1150 h, respectively. Therefore, no matter comparison in terms of creep rate or creep strength, the high temperature creep properties of ODS steel prepared by the invention application of the disclosure are obviously higher than that of those steel made from the traditional smelting process.

DETAILED DESCRIPTION

Embodiment 1

Figure 1:
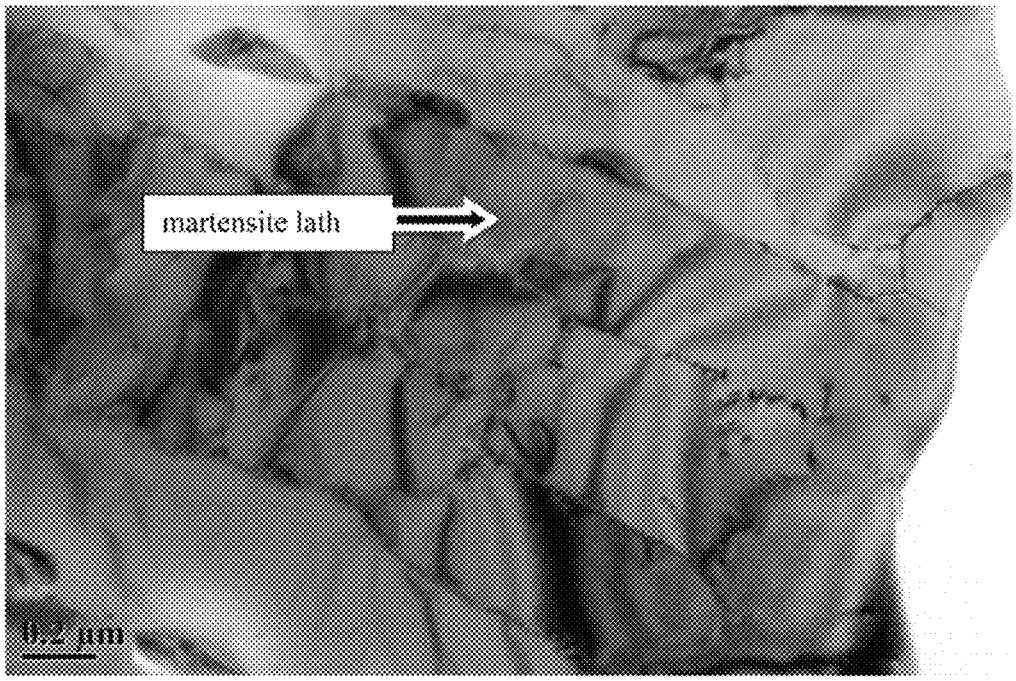
FIG. 1 is a TEM photograph of the disclosure (drawing for embodiment 1)
Figure 2:
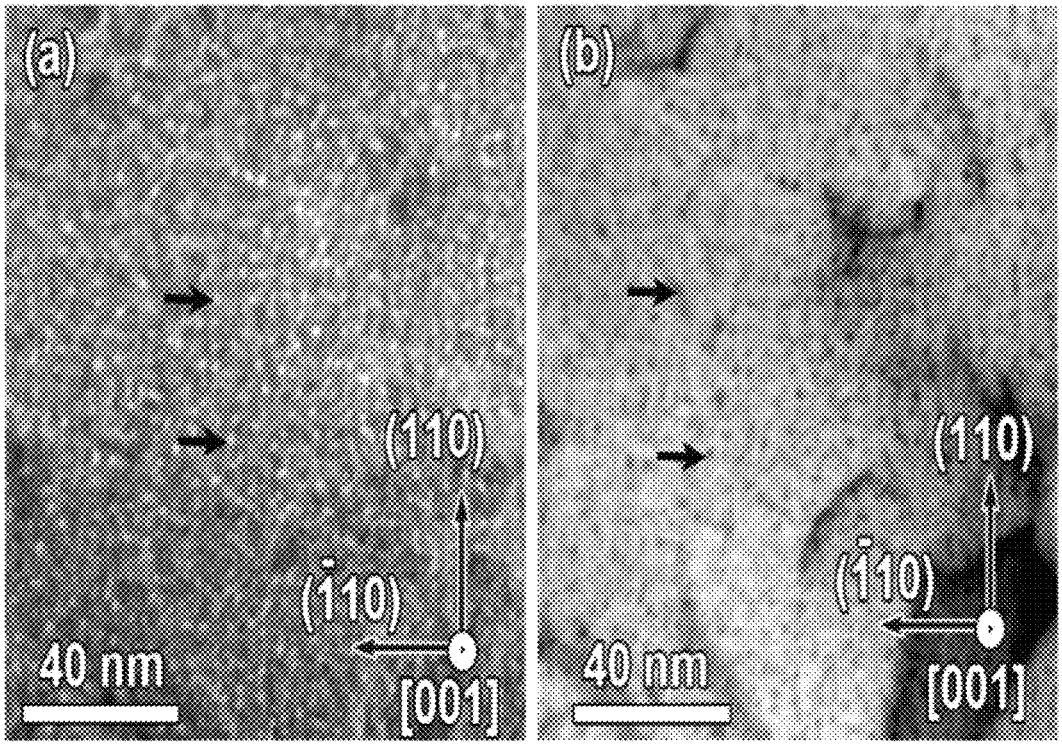
FIG. 2 is a low magnification STEM photograph of spherical aberration corrected transmission electron microscope of the sample in embodiment 1 of the disclosure. [(a) dark field image of the HAADF probe; (b) bright field image corresponding to the same area]
Figure 3:
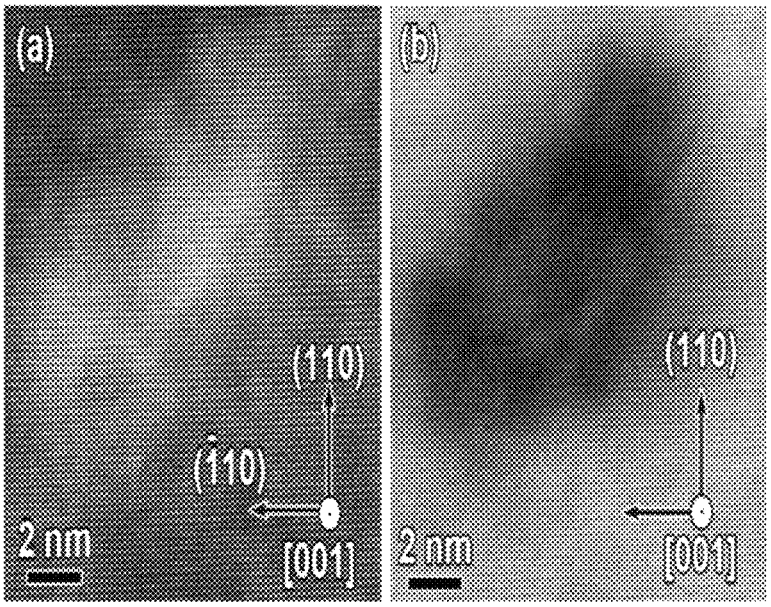
FIG. 3 is a low magnification STEM photograph of the precipitation phase of spherical aberration corrected transmission electron microscope of the sample in embodiment 1 of the disclosure. [(a) dark field image of the HAADF probe; (b) bright field image corresponding to the same area]
Figure 4:
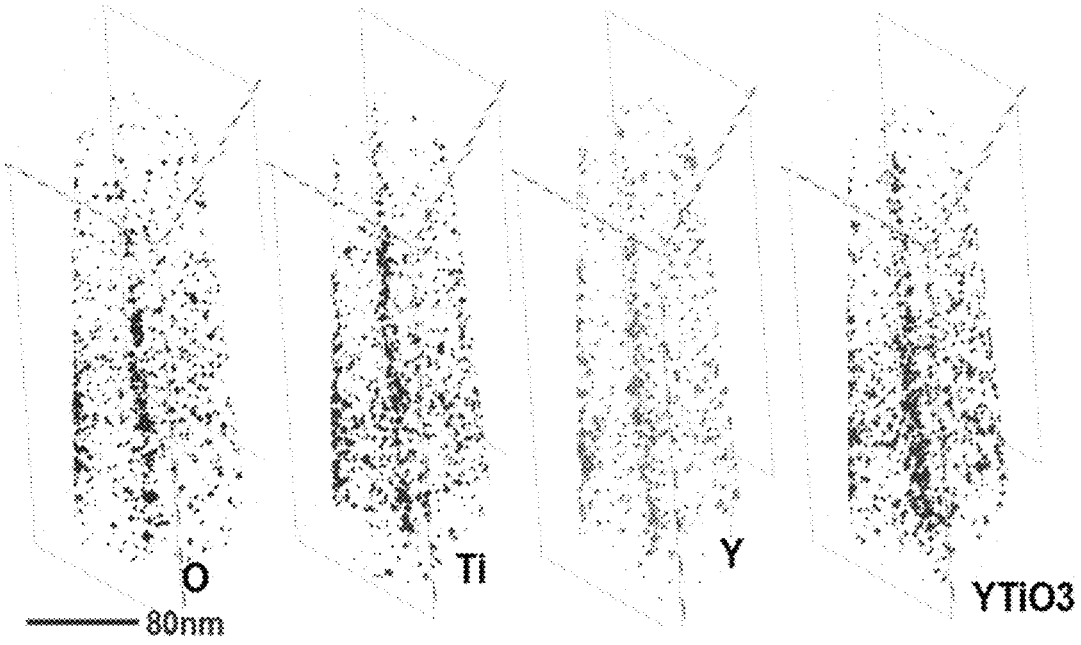
FIG. 4 is a three dimensional scattergram of O, Ti, Y and $YTiO_3$ obtained through equal concentration surface method of samples in embodiment 2 of the disclosure.
Figure 5:
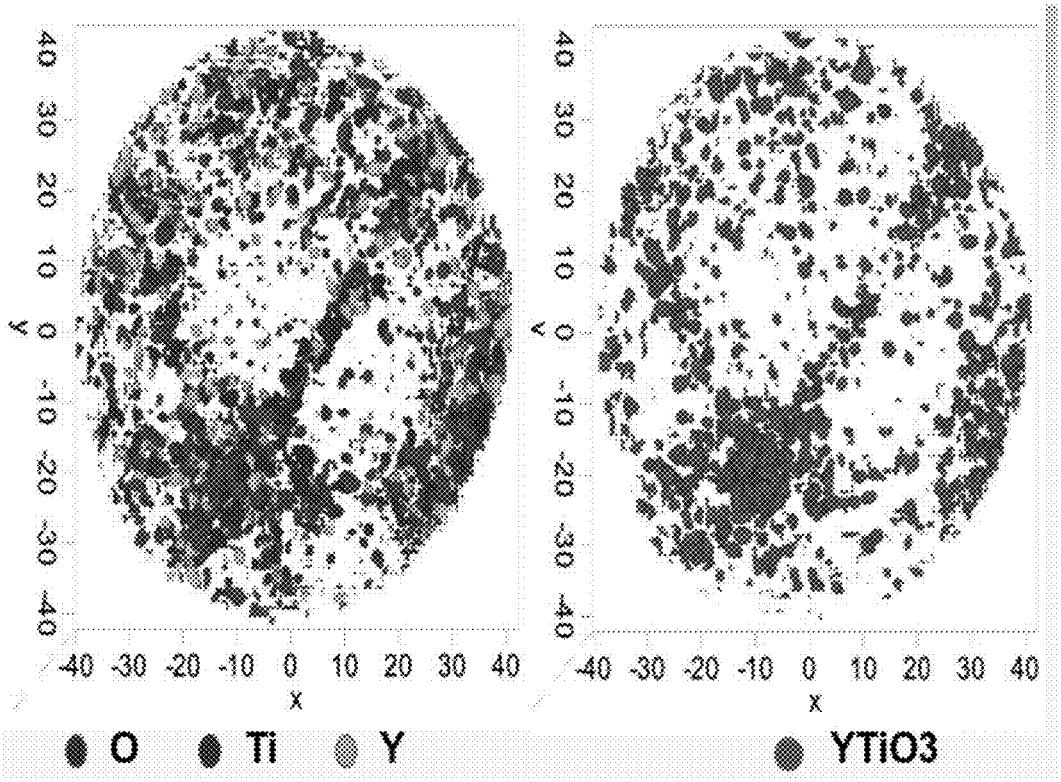
FIG. 5 is a three dimensional scattergram of O, Ti, Y and $YTiO_3$ obtained through equal concentration surface method of samples in embodiment 2 of the disclosure (tip top view)
Figure 6:
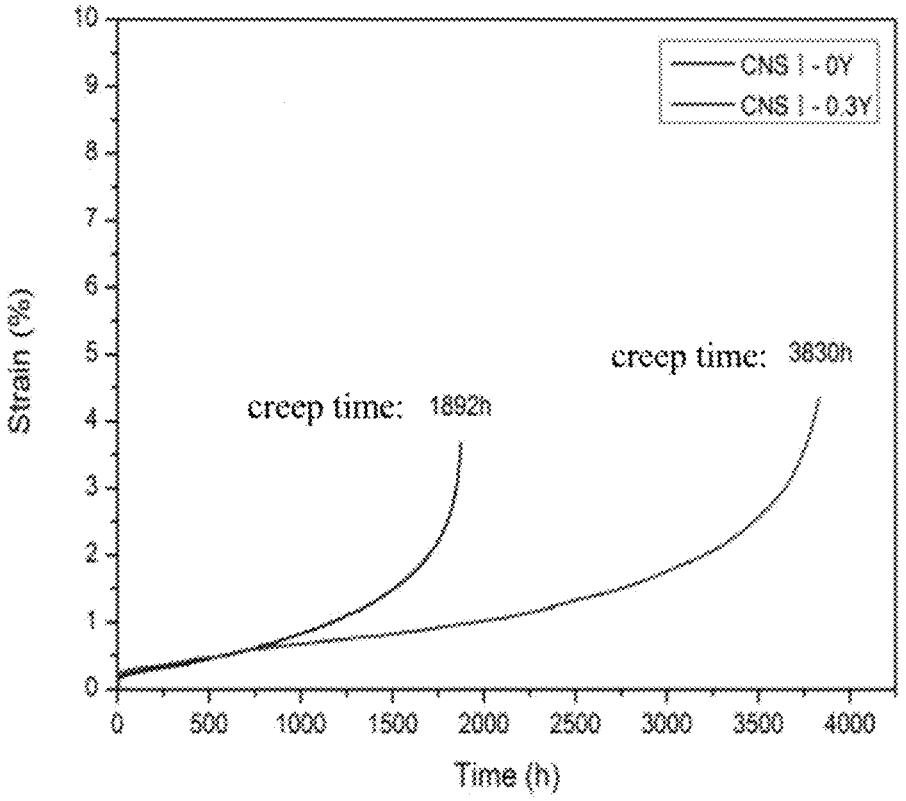
FIG. 6 is a contrast diagram of creep property of embodiment 1 of the disclosure and the traditional F/M steel with the same composition (creep temperature is 650° C., and the stress is 120 MPa)
Figure 7:
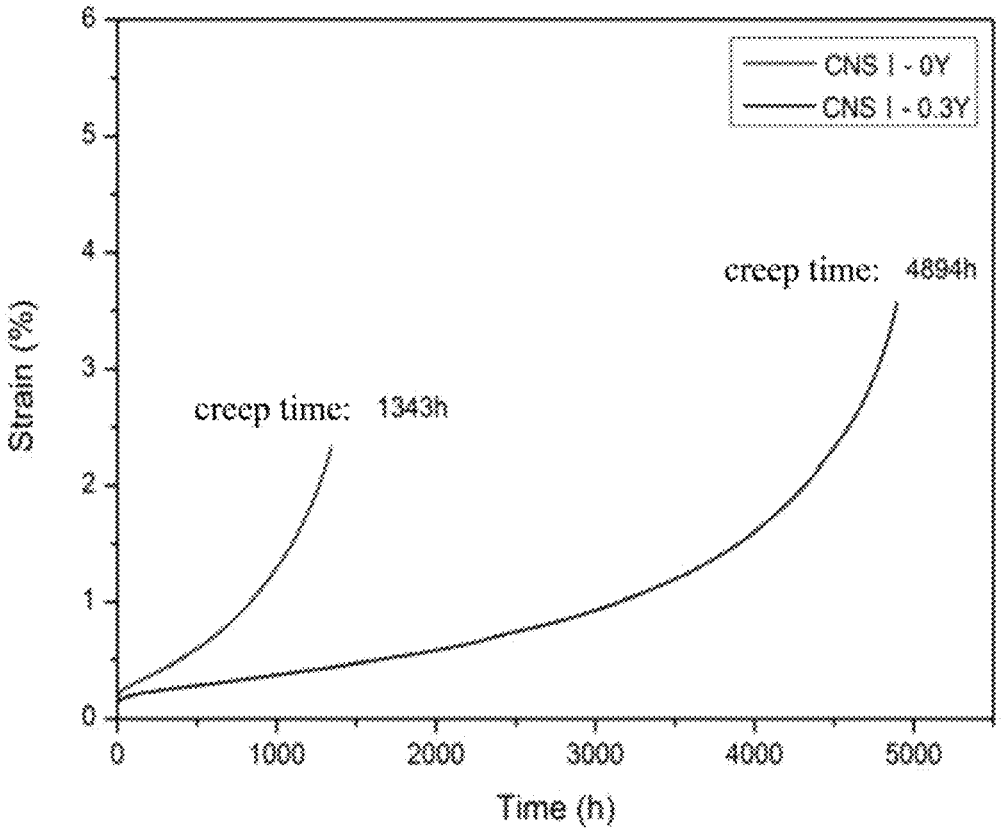
FIG. 7 is a contrast diagram of creep property of embodiment 2 of the disclosure and the traditional F/M steel with the same composition (creep temperature is 650° C., and the stress is 120 MPa).

An ODS RAFM steel is prepared based on the new ODS process, where the percentage of various compositions in total mass includes:

C: 0.08-0.15%, Cr: 8.0-14%, Mn: 0.45-0.6%, W: 1.0-2.5%, N: 0.05-0.07%, Ta: 0.010-0.20%, Ti: 0.02-0.55%, Si: 0.10-0.15%, V: 0.04-0.5%, O: 30-200 ppm B<0.001%, S<0.003%, P<0.005%, the rest is Fe, Y powder in the casting mould: 0.05%. The finished product is made through the following steps:

(a) a steel ingot or continuous casting steel bar is prepared by vacuum smelting in accordance with steps 1, 2, 3 and 4 in the preparation methods of the present disclosure, with the following percentage for various compositions in total mass:

C: 0.08-0.15%, Cr: 8.0-14%, Mn: 0.45-0.6%, W: 1.0-2.5%, N: 0.05-0.07%, Ta: 0.010-0.20%, Ti: 0.02-0.55%, Si: 0.10-0.15%, V: 0.04-0.5%, O: 30-200 ppm B<0.001%, S<0.003%, P<0.005%, the rest is Fe, Y powder in the casting mould: 0.05%.

(b) a first thermal deformation is performed by forging or rolling for steel ingots or continuously casting steel bars, to obtain semi-finished product;

(c) the semi-finished product is heated to 1150° C., and a deformation is performed again by using a controlled rolling and cooling process through hot rolling until a production with required shape and size is obtained;

(d) the production is cooled to below 50° C., and then the production is made into a sample and numbered;

(e) all samples are heated to 1000° C., and are kept for a time period of 15-120 min, to perform austenitizing heat treatment;

(f) all samples are cooled in oil to a temperature of below 50° C., then different numbered samples are heated to 710° C., 750° C. and 800° C. respectively, and are kept correspondingly for a period of time of 90 min and 120 min, to perform tempering heat treatment.

Embodiment 2

An ODS RAFM steel is prepared based on the new ODS process, where the percentage of various compositions in total mass includes:

C: 0.08-0.15%, Cr: 8.0-14%, Mn: 0.45-0.6%, W: 1.0-2.5%, N: 0.05-0.07%, Ta: 0.010-0.20%, Ti: 0.02-0.55%, Si: 0.10-0.15%, V: 0.04-0.5%, 0:30-200 ppm, B<0.001%, S<0.003%, P<0.005%, the rest is Fe, Y powder in the casting mould: 0.8%.

The finished product is made through the following steps:

(a) a steel ingot or continuous casting steel bar is prepared by vacuum smelting in accordance with steps 1, 2, 3 and 4 in the preparation methods of the present disclosure, with the following percentage for various compositions in total mass:

C: 0.08-0.15%, Cr: 8.0-14%, Mn: 0.45-0.6%, W: 1.0-2.5%, N: 0.05-0.07%, Ta: 0.010-0.20%, Ti: 0.02-0.55%, Si: 0.10-0.15%, V: 0.04-0.5%, O: 30-200 ppm, B<0.001%, S<0.003%, P<0.005%, the rest is Fe, Y powder in the casting mould: 0.8%.

(b) a first thermal deformation is performed by forging or rolling for steel ingots or continuously casting steel bars, to obtain semi-finished product;

(c) the semi-finished product is heated to 1200° C. to perform austenitizing, and a deformation is performed again by using a controlled rolling and cooling process through hot rolling until a production with required shape and size is obtained;

(d) the production is cooled to below 50° C., and then the production is made into a sample and numbered;

(e) all samples are heated to 1050° C. for a time period of 120 min, to perform austenitizing heat treatment;

(f) all samples are cooled in water to a temperature of below 50° C., then different numbered samples are heated to 720° C., 750° C. and 780° C. respectively, and are kept correspondingly for a period of time of 90 min and 120 min, to perform tempering heat treatment.

We claim:

1. A method for preparing oxide dispersion strengthening ferritic/martensitic steel using a smelting and casting process, which is characterized by using a vacuum induction and magnetic stirring process for steelmaking, with a smelting temperature above the melting point of iron by 100-200° C.; a molten steel with an oxygen activity of 30-200 ppm is cast into a casting mould with a pre-addition of a rare earth element Y that matches an oxygen concentration [O] in the molten steel, and ODS steel of dispersively distributed rare earth oxide is obtained by the combination of the rare earth element Y and [O] in the molten steel; the steps are as follows:

(1) a rare earth Y powder that matches an amount of $Y_2O_3$ selected is added into the casting mould;

(2) raw materials used are pure iron block as wire, pure chromium powder as coarse particle, pure tungsten powder as coarse particle, pure tantalum powder as coarse particle, pure titanium powder as coarse particle, pure Mn powder as coarse particle, pure silicon block, and pure vanadium powder as fine particle are added to a crucible, power is supplied when the crucible is pumped to a vacuum degree of 5-40 Pa, to start refining, and the smelting temperature is above the melting point of iron by 100-200° C.;

(3) a deoxidation depth is controlled by burning loss of deoxidation element Al in the smelting process, at least one alloying element is added to conduct alloying when oxygen concentration [O] reaches 30 ppm-200 ppm;

(4) after the alloying process is finished, the molten steel is cast into the casting mould, and a casting temperature depends on a fluidity of the molten steel; a temperature of the molten steel is reduced as far as possible while the fluidity is ensured;

(5) hot forging and hot rolling are performed to obtain a casting ingot;

(6) heat treatment is performed for a heat-processed slab, to obtain oxide dispersion strengthening ferritic/martensitic steel.

2. The method for preparing oxide dispersion strengthening ferritic/martensitic steel using the smelting and casting process according to claim 1, wherein the purity of each of the raw materials is above 99.9%; the coarse particle refers to the particle with a size of greater than or equal to 297 μm, and the fine particle refers to the particle with a size of smaller than or equal to 15 μm.

3. The method for preparing oxide dispersion strengthening ferritic/martensitic steel using the smelting and casting process according to claim 1, wherein percentages for various compositions in total mass are as follows: C: 0.08-0.15%, Cr: 8.0-14%, Mn: 0.45-0.6%, W: 1.0-2.5%, N: 0.05-0.07%, Ta: 0.010-0.20%, Ti: 0.02-0.55%, Si: 0.10-0.15%, V: 0.04-0.5%, O: 30-200 ppm, B<0.001%, S<0.003%, P<0.005%, Y powder in the casting mould: 0.01-1%, the rest is Fe.

4. The method for preparing oxide dispersion strengthening ferritic/martensitic steel using the smelting and casting process according to claim 1, wherein the steps of hot forging and hot rolling are as follows:

(1) a first thermal deformation is performed by hot forging and hot rolling for steel ingots or continuously casting steel bars, to obtain a semi-finished product;

(2) the semi-finished product is heated to a range of 1150° C.-1200° C., and a second deformation is performed by using a controlled rolling and cooling process through hot rolling until a production with required shape and size is obtained;

(3) a production cooled to a room temperature is heated to a temperature range of 850-1100° C. for 15-120 min, to perform austenitizing heat treatment;

(4) the production after austenitizing heat treatment is cooled to a temperature of below 50° C., and then the production is heated to a temperature range of 710-800° C. for 90-150 min, to perform tempering heat treatment to obtain martensite.

5. The method for preparing oxide dispersion strengthening ferritic/martensitic steel using the smelting and casting process according to claim 4, wherein a temperature range of hot forging and hot rolling in step (1) is 800° C.-1100° C.

6. The method for preparing oxide dispersion strengthening ferritic/martensitic steel using the smelting and casting process according to claim 4, wherein a cooling operation after the thermal deformation in step (1) is first performed in water to cool to 600° C., and then performed in air to cool to room temperature.

7. The method for preparing oxide dispersion strengthening ferritic/martensitic steel using the smelting and casting process according to claim 4, wherein for the controlled rolling and cooling process in step (2), an onset rolling temperature is controlled at 1050-1100° C., a final rolling temperature is controlled at 800-950° C., and online spray cooling is used after rolling.

8. The method for preparing oxide dispersion strengthening ferritic/martensitic steel using the smelting and casting process according to claim 4, wherein the austenitizing heat treatment system in step (3) and (4) is: quenching at 850-1100° C. for 15-120 min, tempering at 710-800° C. for 90-120 min; and a cooling operation after austenitizing heat treatment is performed in oil.

9. The method for preparing oxide dispersion strengthening ferritic/martensitic steel using the smelting and casting process according to claim 4, wherein a cooling operation after tempering heat treatment in step (4) is performed in air.

* * * * *